US005456617A

United States Patent [19]

Chishima et al.

[11] Patent Number: 5,456,617

[45] Date of Patent: Oct. 10, 1995

[54] JOINT CONNECTOR

[75] Inventors: Masamitsu Chishima; Yutaka Noro, both of Yokkaichi, Japan

[73] Assignee: Sumitomo Wiring Systems, Ltd., Japan

[21] Appl. No.: 381,772

[22] Filed: Feb. 1, 1995

Related U.S. Application Data

[62] Division of Ser. No. 203,332, Feb. 28, 1994, Pat. No. 5,403,204.

[30] Foreign Application Priority Data

| | | | |
|---|---|---|---|
| Mar. 3, 1993 | [JP] | Japan | 5-8505 U |
| Mar. 9, 1993 | [JP] | Japan | 5-9892 U |
| May 25, 1993 | [JP] | Japan | 5-146850 |
| Jun. 3, 1993 | [JP] | Japan | 5-160144 |

[51] Int. Cl.[6] ..... H01R 31/08

[52] U.S. Cl. ..... 439/513; 439/189

[58] Field of Search ..... 439/513, 512, 439/509, 507, 721, 723, 724, 728, 729, 189, 511

[56] References Cited

U.S. PATENT DOCUMENTS

| | | | |
|---|---|---|---|
| 3,373,398 | 3/1968 | Volinskie | 439/189 X |
| 3,594,714 | 7/1971 | Paullus | 439/189 X |
| 4,940,430 | 7/1990 | Fujitani et al. | 439/352 OR |
| 5,007,888 | 4/1991 | Goutiere | 439/189 OR |

*Primary Examiner*—David L. Pirlot
*Assistant Examiner*—Daniel Wittels
*Attorney, Agent, or Firm*—Jordan B. Bierman; Bierman and Muserlian

[57] ABSTRACT

A joint connector having a connector housing and containing electrical wires having terminals on their distal ends. Some terminals are electrically coupled to each other through a shorting plate. There are two groups of chambers accommodating terminals, one group over the other, with a joint chamber between. Apertures in at least some of each group of chambers are in communication with the joint chamber and the shorting plate is in the joint chamber facing the apertures. The chambers have open ends, into which terminals are introduced, and closed ends remote therefrom. Some of each group of chambers have open ends facing front and some of each group of chambers have open ends facing back. Certain of the terminals have tongue pieces which project through the apertures into the joint chamber when they are in the chambers.

5 Claims, 12 Drawing Sheets

JOINT CONNECTOR

This Application is a Division of U.S. application Ser. No. 08/203,332, filed Feb. 28, 1994, now U.S. Pat. No. 5,403,204; which claims the priority of Japanese Applications 8505/1993, filed Mar. 3, 1993, 9892/1993, filed Mar. 9, 1993, 146850/1993, filed May 25, 1993, and 160144/1993, filed Jun. 3, 1993.

BACKGROUND OF THE INVENTION

1. Field of the Invention

This invention relates to a joint connector which is used to interconnect wire harnesses for an automobile and the like.

2. Statement of the Prior Art

For convenience of explanation a conventional joint connector will be described below by referring to FIGS. 15 to 22. FIG. 15 is an exploded longitudinal sectional view of a prior joint connector as seen before having a cover mounted thereon. FIG. 16 is a longitudinal sectional view of a part of the joint connector shown in FIG. 15, illustrating the connector on which the cover is mounted.

FIG. 17 is a longitudinal sectional view of a part of the joint connector shown in FIG. 15, illustrating the connector in which a female terminal is incompletely inserted into a connector housing. FIG. 18 is an enlarged view of a main part of FIG. 17. FIG. 19 is a schematic fragmentary cross sectional view of a prior joint connector. FIG. 20 is a schematic perspective view of a prior joint connector. FIG. 21 is an exploded longitudinal sectional view of a prior joint connector. FIG. 22 is a side elevational view of the prior joint connector which joints electrical wires.

FIGS. 15 and 16 show an example of a conventional joint connector (Japanese Utility Model Public Disclosure No. 3-88278 (1991)). A female terminal 2 is accommodated in a terminal accommodating chamber 1*a* in a connector housing 1. The terminal accommodating chamber 1*a* is provided on its side walls (upper and lower walls) 1*b* with a resilient locking finger 1*d* having a projection 1*c* which engages with a lock aperture 2*a* in the female terminal 2.

A cover 4 having a male terminal 3 is mounted on the connector housing 1 so that the male terminal 3 is coupled to the female terminal 2 (FIG. 16).

The locking finger 1*d* of the connector housing 1 is provided on the same plane as an outer face of the side wall 1*b* in the housing 1. In the case that the female terminal 2 is incompletely received in the terminal accommodating chamber 1*a* as shown in FIG. 17. The projection 1*c* on the locking finger 1*d* rides on an outer face of the female terminal 2 so that the locking finger 1*d* projects from the outer face of the side wall 1*b*.

Consequently, when the cover 4 is mounted on the connector housing 1, a distal end of the locking finger 1*d* abuts on a stopper 4*a* of the cover 4, thereby preventing any further advance of the cover 4. Accordingly, it is possible to prevent a connecting failure of the male terminal 3 resulting from an incomplete insertion of the female terminal 2.

On the other hand, in the case that the female terminal 2 is detached from the terminal accommodating chamber 1*a* in order to change an accommodating position of the female terminal 2, after the female terminal 2 has been accommodated in the terminal accommodating chamber 1*a* in the connector housing 1, the projection 1*c* must be drawn from the lock aperture 2*a* in the female terminal 2 by pushing the locking finger 1*d* outwardly.

Accordingly, as shown in FIG. 18, a plate like tool 5 is inserted between the distal end of the locking finger and an inner end 1*e* of the side wall 1*b* of the connector housing 1, which is opposed to the distal end of the finger 1*d*, the tool 5 is swung about a corner a of the inner end 1*e* as a fulcrum, and the tool 5 pushes up the locking finger 1*d* at an acting point b on the end of the finger 1*d*.

However, a gap between the distal end of the locking finger 1*d* and the inner end 1*e* is so narrow that the tool 5 hardly enters into the gap and a distance between the fulcrum a and the acting point b is so short that an excessive stress is concentrated on the locking finger 1*d*, thereby deforming the locking finger 1*d*.

There are some prior joint connectors which are suitable for wiring alternation in electrical equipment for an automobile, an OA device such as a copying device and the like, and an industrial device. In particular, it is necessary to prevent a short-circuit from occurring between branched circuits due to leaking in such joint connectors.

Such joint connectors are shown in FIGS. 19 and 20.

In the joint connector, a plurality of terminal accommodating chambers 1*a* are formed in the connector housing 1 by partitions 1*f*. A female terminal 2 is accommodated in the chamber 1*a* and shorting plates 3A and 3B are inserted into the connector housing 1. Each of the shorting plates 3A and 3B has a coupling portion 3*a* and a plurality of contacting portions 3*b* integrally connected to the coupling portion 3*a*. The contacting portions contact with the female terminal 2 to form a branched circuit.

The connector housing 1 is integrally provided with a lid 7, which serves to prevent the shorting plates 3A and 3B from sliding out of the connector housing 1 when the housing 1 is closed by the lid 7.

In the joint connector, each of the shorting plates 3A and 3B is provided with a recess 3C. The lid 7 is provided with protrusions 7*a* corresponding to the recesses 3C. When the lid 7 closes the housing 1, the protrusions 7*a* engage with the recesses 3C to hold the shorting plates 3A and 3B in regular positions, thereby preventing the shorting plates 3A and 3B from loosening in the connector housing 1 and from shorting two branched circuits due to contact of the adjacent shorting plates 3A and 3B. Such a joint connector is disclosed in Japanese Utility Model Public Disclosure No. 64-55591 (1989).

However, in the above joint connector, a gap 8 between the adjacent shorting plates 3A and 3B is insulated only by air. Thus, in the case that potentials in the branched circuits formed by the respective shorting plates 3A and 3B are different or in the case that moisture or dust exists in the gap 8, leaking will occur between the shorting plates 3A and 3B at the gap 8, thereby shorting the branched circuits formed by the shorting plates 3A and 3B.

It is desirable to make the partition as thin as possible in order to make the joint connector compact and light in the case of using it in an automobile, an OA device, or the like. However, if the partition 1*f* becomes thin, a pitch between the female terminals 2 will become narrow and the gap 8 will become so small that a distance of air insulation is short, thereby readily causing leaking.

FIG. 21 shows a conventional joint connector which accommodates electrical wires an end of which is connected to a terminal and interconnects given terminals.

In FIG. 21, a female connector housing 1 accommodates a plurality of electrical wires 9 which are directed to the same sense and have a female terminal 2 at one end. A male connector housing 4A is formed into a box like shape having at an end an opening which is adapted to receive an end of the female connector housing 1. The male connector housing 4A is provided at a bottom wall with a shorting plate 3C which extends inwardly and is directed to the positions of the female terminals in the female connector housing 1. The shorting plate 3C is formed into a U-shape and provided with two distal ends which have the same shape as that of the male terminals. A cover 6 is provided to be mounted on an outer periphery of the male connector housing 4A from its rear side. In order to prevent the cover 6 from falling off the male connector housing 4A, the cover 6 is provided with an aperture *6a* while the male connector housing 4A is provided with a projection *4a*.

In the above construction, an integrated shorting plate 3C is formed in accordance with female terminals to be connected with each other. The shorting plate 3C is inserted into the male connector housing 4A from its rear side. The cover 6 is put on the housing 4A. Thereafter, the female connector housing 1 is inserted into the male connector housing 4A through its opening so that the shorting plate 3C advances in the female terminal 2. Eventually, desired female terminals 2 are electrically interconnected through the shorting plate 3C.

However, in the case that the electrical wires 9 to be connected with each other are drawn from different two places, as shown in FIG. 22, the wires 9 are bent at their end and thus the joint connector is arranged in perpendicular to the electrical wires 9.

In the above conventional joint connector, since the shorting plate is inserted into the female terminal, the female terminals must be arranged to close their openings and to direct them in the same sense. Consequently, if the electrical wires 9 to be interconnected are collected from different places, the joint connector projects on wiring parts, thereby obstructing another wirings.

Further, an example of a joint connector which interconnects a plurality of electrical wires is disclosed in Japanese Patent Public Disclosure No. 61-277180 (1986).

In the joint connector, a plurality of same terminal accommodating chambers in a connector housing receive an end portion of an electrical wire having a female terminal at an end and a plurality of male terminals to be inserted in the female terminals are provided on the terminal accommodating chambers. The male terminals are coupled to each other in connection with the female terminals to be connected to each other.

When the female connector housing is inserted into the male connector housing after the female terminal is connected to an end of the electrical wire to be connected to another wire and the female terminal is accommodated in the terminal accommodating chamber in the female connector housing, the male terminals which are interconnected in the male connector housing enter into the given female terminals, so that a plurality of female terminals are electrically interconnected through the male terminals.

This joint connector is also utilized to branch electrical wires connected to an electrical power source to electrical wires for electrical power sources in a plurality of electrical devices. The electrical wires connected to the electrical power source require a diameter large enough to supply currents to each electrical devices in comparison with branched wires. However, in the prior joint connector, since each size of the terminal accommodating chambers for receiving the electrical wires is same, the electrical wires having a large diameter can not be inserted into the chambers even if they are desired to be used.

SUMMARY OF THE INVENTION

A first object of the present invention is to provide a joint connector which makes it easy to insert a tool therein upon detaching a female terminal therefrom and prevents a locking finger from being deformed.

A second object of the present invention is to provide a joint connector which prevents leaking between branched circuits in a connector housing.

A third object of the present invention is to provide a joint connector which avoids interference upon connecting alternately electrical wires directed in opposite directions.

A fourth object of the present invention is to provide a joint connector which can use electrical wires having different diameters.

In order to achieve the first object, a joint connector of the present invention comprises: a connector housing having a plurality of terminal accommodating chambers which are formed by partitioning an interior thereof by means of side walls; a female terminal accommodated in each of the chambers; and at least one shorting plate having a coupling portion and a plurality of contact portions juxtaposed together to coupling portion and contacting with the female terminal to form at least one branched circuit. The side wall of the terminal accommodating chamber in the connector housing is provided with a resilient locking finger having a lock projection adapted to be engaged with a lock aperture in the female terminal accommodated in the chamber. The side wall of the connector housing is provided on an outer face with a slanted portion which inclines and extends outwardly from an end face opposite to a distal end of said locking finger to the outer face.

The locking finger is arranged inwardly below the outer face of said side wall. The slanted portion extends from an inward position aligned to the distal end of the locking finger to an outward position.

The locking finger may be arranged on a plane aligned with the outer face of the side wall.

If marks such as digits indicating pole numbers of female terminals which are accommodated in terminal accommodating chambers are carved on the slanted portion, it is possible to confirm a position in which a certain female terminal should be inserted and to enhance accommodating work.

The marks may be carved on outer face extending from the slanted portion of the side wall.

According to the present invention, since the locking finger is arranged inwardly below the outer face of the side wall, and wherein the slanted portion extends from an inward position aligned to the distal end of the locking finger to an outward position, a gap between the distal end of the locking finger and the inner end face of the side wall can be widened and the tool can be guided along the slanted portion to be easily inserted into the gap. Also, since the fulcrum for swinging the tool exists at an upper end of the slanted portion, a distance from the fulcrum and the acting point becomes long and excessive stress is not concentrated on the locking finger which would otherwise deform it.

In the case that the locking finger is arranged below the outer face of the side wall of the connector housing, the locking finger hardly receives any impact from the exterior.

Further, if marks such as digits indicating pole numbers of female terminals which are accommodated in terminal accommodating chambers are carved on the outer face of the side wall continued to the slanted portion, it is possible to confirm a position in which a certain female terminal should be inserted and to enhance accommodating work.

In order to achieve the second object, the joint connector of the present invention is common to an all pole shorting use in which a single shorting plate connects a plurality of female terminals to a single branched circuit and to a divisional shorting use in which a plurality of shorting plates connect the terminals to more than two branched circuits, wherein the coupling portion of the shorting plate or plates abut on distal ends of the side walls of said connector housing to limit an inserting position of the plate. The connector housing includes first side walls the distal ends of which abut on the coupling portions of the shorting plates for the divisional shorting use and a second side wall the distal end of which abuts on the coupling portion of the shorting plate for the all pole shorting use.

The distal end of the second side wall for positioning the shorting plate for all pole shorting use extends by more than the width of the coupling portion of the shorting plate above the distal ends of the side walls for positioning the shorting plates for the divisional shorting use.

According to the above construction of the joint connector of the present invention, the connector housing can be used in both all pole shorting function and divisional shorting function. Since the side wall is disposed between the divisional shorting plates, insulation between the shorting plates is improved, so that leaking is prevented.

In the case that the distal end of the second wall for positioning the shorting plate for the all pole shorting use extends by more than a width of said coupling portion of the shorting plate above the distal ends of the side walls for positioning the shorting plates for the divisional shorting use, it is possible to more enhance insulation between the shorting plates, thereby positively preventing leaking.

To achieve the above third object, in the joint connector of the present invention, the terminal accommodating chambers are arranged one upon another in the connector housing. A joint chamber is formed between the respective terminal accommodating chambers piled on each other. An aperture is formed in each terminal accommodating chamber to communicate with the joint chamber. Each opening of the terminal accommodating chamber is arranged alternately in the reverse direction. The shorting plate is inserted into the joint chamber to confront the given aperture. The female terminal is provided with a tongue piece which projects through the aperture into the joint chamber when inserted into the terminal accommodating chamber.

In the joint connector of the present invention constructed as above, the terminal accommodating chambers are arranged one upon another in the connector housing, so that the electrical wires disposed in the opposite directions are alternately aligned in a straight line. On the other hand, since the shorting plate is inserted into the joint chamber to confront the given aperture, the tongue piece elastically contacts with the shorting plate through the aperture when the female terminal is accommodated in the terminal accommodating chamber. Thus, the female terminals which contact with the shorting plate are electrically connected with each other.

In comparison with the prior joint connector in which the female terminals contact with the shorting plate from the same direction, the terminal accommodating chambers can be arranged in any direction, since the female terminals can contact with the shorting plate disposed in the chambers.

In order to achieve the fourth object, in the joint connector of the present invention, the terminal accommodating chambers are formed into different sizes corresponding to the different diameters of electrical wires to be connected to the terminals.

The female terminal is provided with a common contacting portion which contacts with the shorting plate and a barrel portion which has different sizes corresponding to the different diameters of the electrical wire. The terminal accommodating chamber is formed so that its interior holds the common contacting portion.

According to the joint connector of the present invention, since the terminal accommodating chambers have different sizes, the electrical wires with different diameters can be simultaneously accommodated in the chambers.

Since the contacting portions of the female terminals are formed into the same shape although the barrel portions of the female terminals are formed into different sizes in accordance with the diameters of the electrical wires to be interconnected, and since the terminal accommodating chambers are formed into the same shape to hold the contacting portions of the female terminals, the terminal accommodating chamber adapted to receive an electrical wire having a large diameter can receive and hold an electrical wire having a small diameter.

DETAILED DESCRIPTION OF THE PREFERRED EMBODIMENTS

Referring now to FIGS. 1 to 14, embodiments of a joint connector of the present invention will be explained below.

Figure 1:
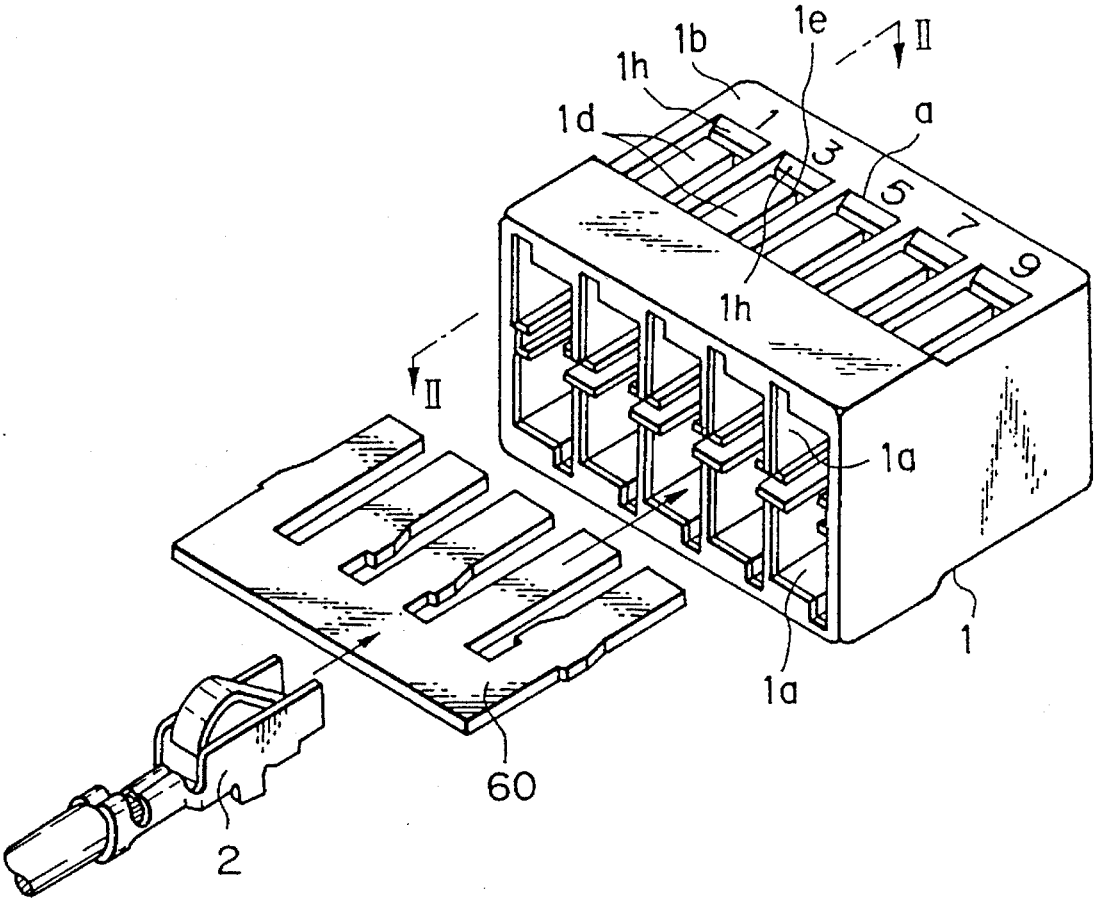
FIG. 1 is an exploded perspective view of a first embodiment of a joint connector of the present invention.
Figure 2:
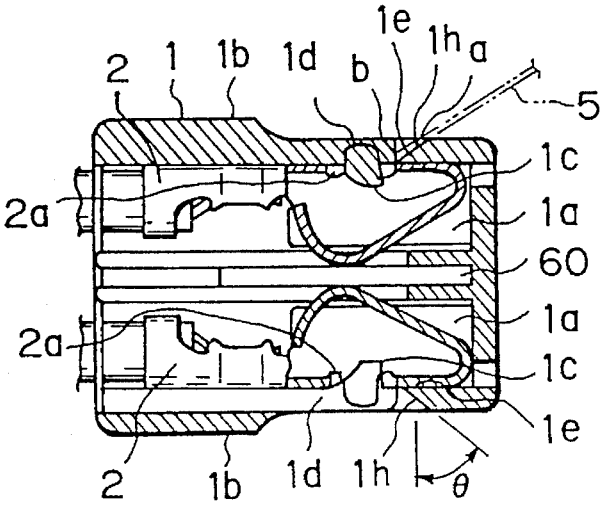
FIG. 2 is a longitudinal sectional view taken along lines II—II in FIG. 1.

FIGS. 1 and 2 show a first embodiment of the joint connector of the present invention. A connector housing 1 has ten terminal accommodating chamber 1*a* with five chambers 1*a* being arranged in upper and lower stages. A shorting plate (metal plate) 60 is inserted and held in the connector housing 1 between the upper and lower terminal accommodating chambers 1*a*.

A female terminal 2 is accommodated in the terminal accommodating chamber 1*a*. The female terminal 2 is provided with a lock aperture 2*a*.

The connector housing 1 is provided on a side wall 1*b* (upper side wall 1*b* in the upper chamber 1*a* and lower side wall 1*b* in the lower chamber 1*a*) with a locking finger 1*d* having a projection 1*c* which engages with the lock aperture 2*a*. The locking finger 1*d* is aligned on the outer face of the side wall of the connector housing 1. That is, the locking finger 1*d* is formed by cutting the side wall 1*b* at three sides so that the finger 1*d* can be deflected upwardly and downwardly.

An outwardly slanted portion 1*h* is formed on an inner end 1*e* which is opposed to a distal end of the locking finger 1*d*. Preferably, an inclination angle O of the slanted portion 1*h* with respect to a longitudinal line at one half of a thickness of the side wall 1*b* is in a range of 10 through 80 degrees.

Since an area of the slanted portion 1*h* is smaller than that of a second embodiment described hereinafter, digits 1 to 10 indicating a pole number of the female terminal 2 are carved on not the slanted portion 1*h* but an outer face of the side wall 1*b* continued to the portion 1*h*.

When the female terminal 2 is completely inserted into the terminal accommodating chamber 1*a* in the connector housing 1, the projection 1*c* engages with the aperture 2*a* in the female terminal 2 to lock the terminal 2.

Figure 17:
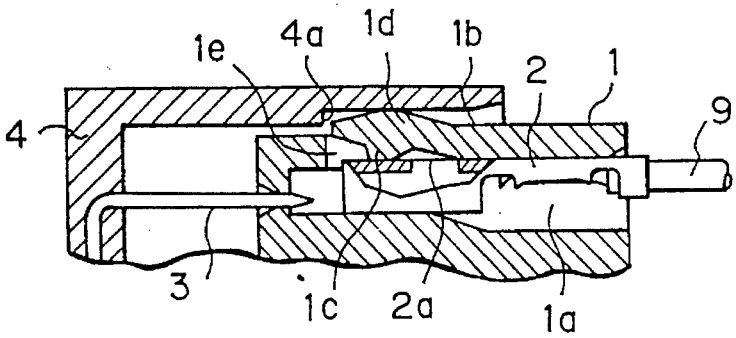
Fig. 17 PRIOR ART
FIG. 17 is a longitudinal sectional view of a part of the joint connector shown in FIG. 15, illustrating the connector in which a female terminal is incompletely inserted into a connector housing.

On the other hand, in the case that the female terminal 2 is incompletely inserted into the terminal accommodating chamber 1*a* in the connector housing 1, the projection 1*c* on the locking finger 1*d* rides on an outer face of the female terminal 2, so that the locking finger 1*d* projects outwardly from the outer face of the side wall 1*b* in the same manner as the prior art (see FIG. 17). Consequently, a cover (not shown) can not be mounted on the connector housing 1. This indicates an incomplete coupling of the female terminal.

In the case that the female terminal 2 is detached from the terminal accommodating chamber 1*a* in order to alter an accommodating position of the female terminal 2 after the female terminal 2 has been accommodated in the chamber 1*a* in the connector housing 1, a flat tool 5 is inserted at its end from the outside into a gap between the distal end of the locking finger 1*d* and the inner end 1*e* (FIG. 2).

Upon inserting the tool 5, the slanted portion 1*h* widens the gap between the distal end of the locking finger 1*d* and the inner end 1*e* and guides the tool 5, thereby making it easy to insert the tool 5 into the gap.

Figure 18:
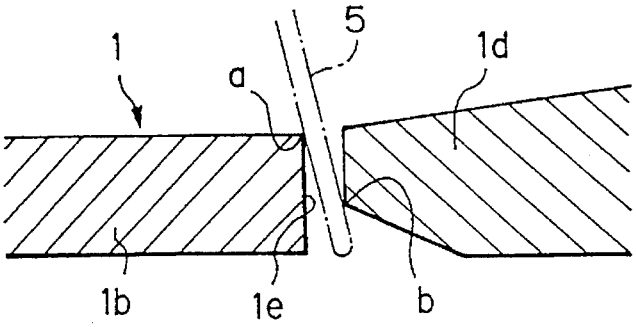
Fig. 18 PRIOR ART
FIG. 18 is an enlarged view of a main part of FIG. 17.
Figure 19:
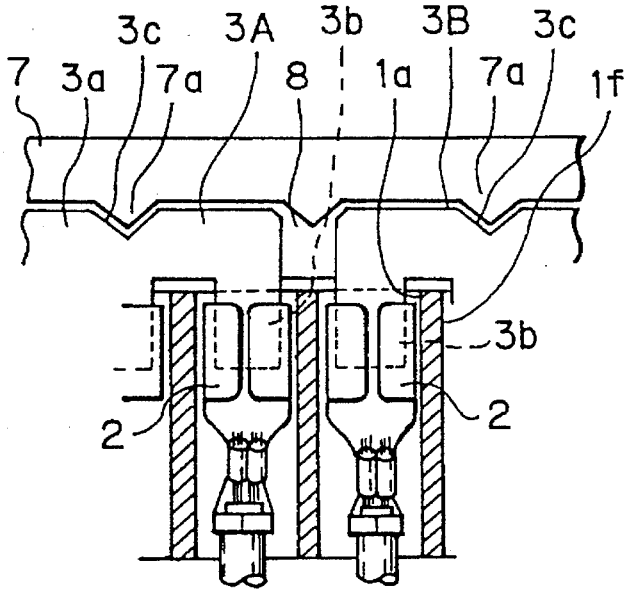
Fig. 19 PRIOR ART
FIG. 19 is a schematic fragmentary cross sectional view of a prior joint connector.
Figure 20:
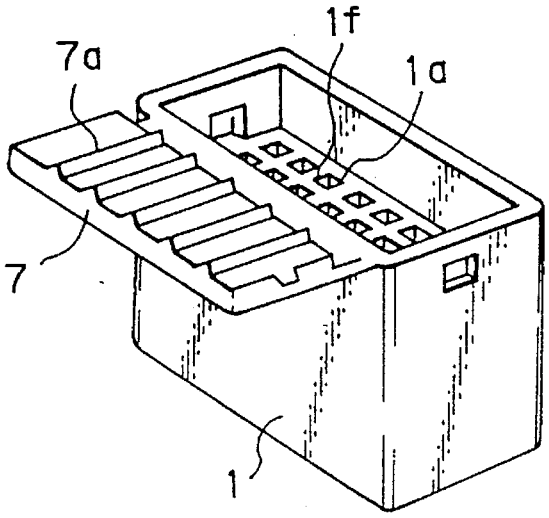
Fig. 20 PRIOR ART
FIG. 20 is a schematic perspective view of a prior joint connector.
Figure 21:
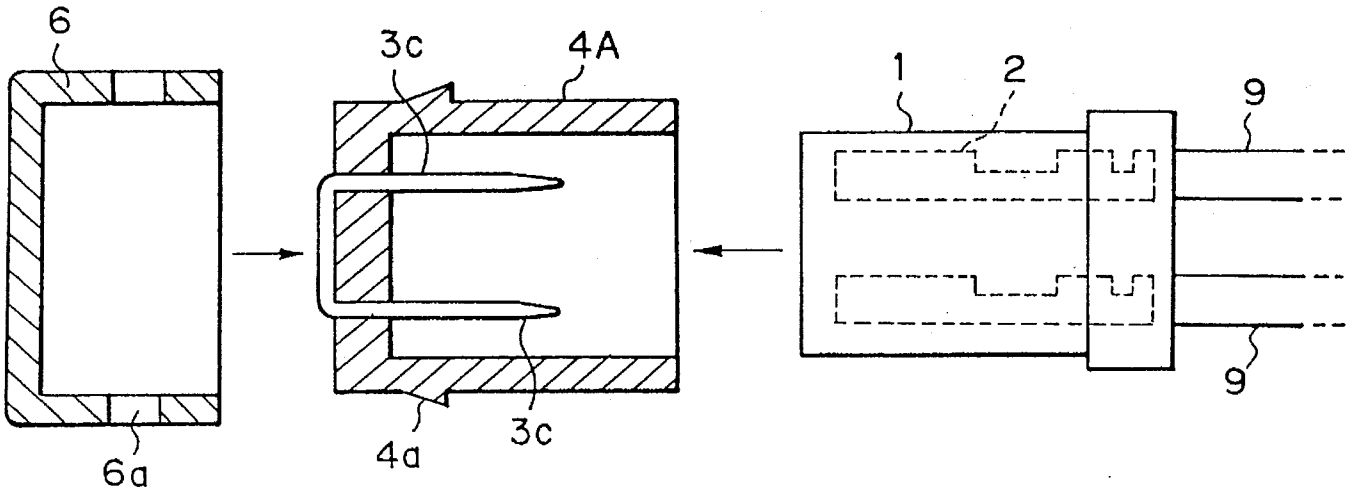
Fig. 21 PRIOR ART
FIG. 21 is an exploded longitudinal sectional view of a prior joint connector.
Figure 22:
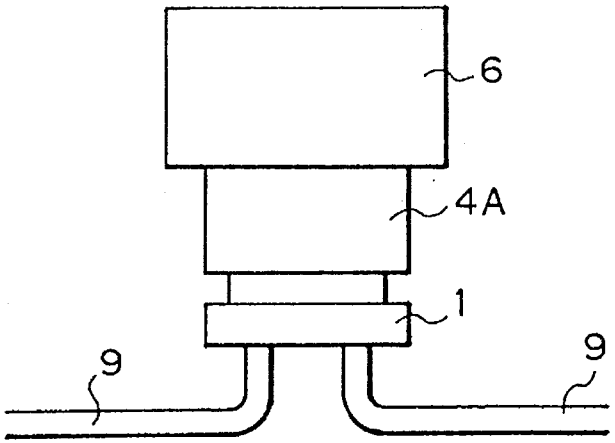
Fig. 22 PRIOR ART
FIG. 22 is a side elevational view of the prior joint connector which joints electrical wires.

When the tool 5 is swung outwardly after inserting it so that it pushes up the locking finger 1*d* and the projection 1*c* is disengaged from the aperture 2*a*, the tool 5 is swung about the fulcrum a at the upper end of the slanted portion 1*h* of the side wall 1*b*. Consequently, a distance between the fulcrum a and the acting point b at the distal end of the tool 5 becomes longer than that of the prior art (see FIG. 18). Excessive stress is not concentrated on the locking finger 1*d* which would otherwise deform it.

Although the above joint connector has an all pole shorting plate 60, the connector may have divisional shorting plates 60A and 60B described hereinafter.

Figure 3:
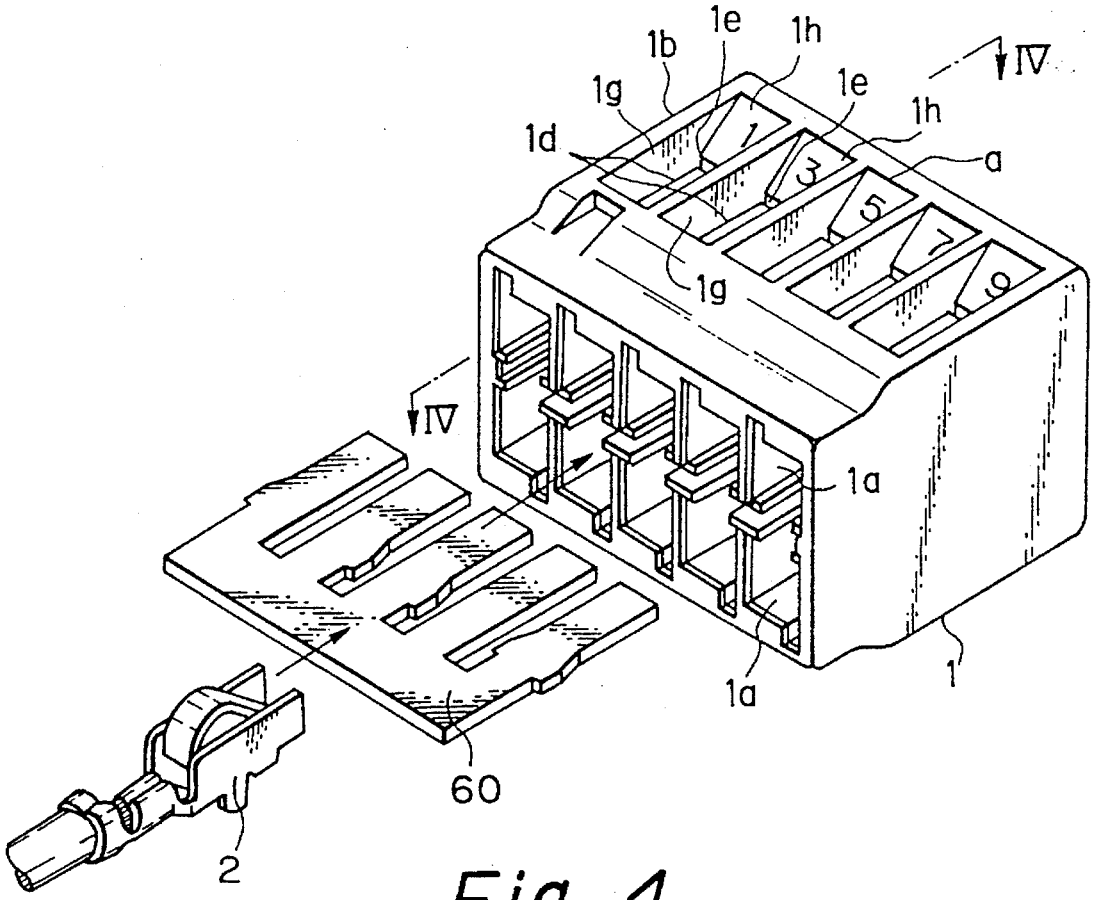
FIG. 3 is an exploded perspective view of a second embodiment of a joint connector of the present invention.
Figure 4:
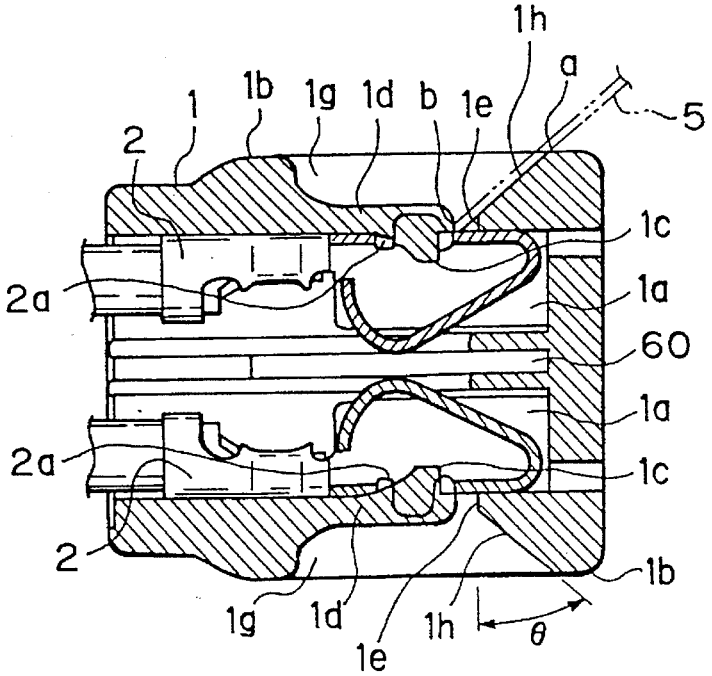
FIG. 4 is a longitudinal sectional view taken along lines IV—IV in FIG. 3.

FIGS. 3 and 4 show a second embodiment of the joint connector of the present invention. The connector housing 1 is provided on the side wall 1*b* of the terminal accommodating chamber 1*a* with the locking finger 1*d* which is arranged below the outer face of the side wall 1*b* of the connector housing 1. That is, a recess 1*g* is formed on the outer face of the side wall 1*b* and the locking finger 1*d* is formed at the bottom of the recess 1*g*. The locking finger 1*d* is formed by cutting the side wall 1*b* at three sides so that the finger 1*d* can be deflected upwardly and downwardly.

An outwardly slanted portion 1*h* is formed on an inner end 1*e* which is opposed to a distal end of the locking finger 1*d*. The slanted portion 1*h* extends to the outer face of the side wall 1*b*. Preferably, an inclination angle O of the slanted portion 1*h* with respect to a longitudinal line at one half of a thickness of an edge of the inner end 1*e* is in a range of 10 through 80 degrees.

Digits 1 to 10 indicating a pole number of the female terminal 2 are carved on the slanted portion 1*h*.

When the female terminal 2 is incompletely inserted into the terminal accommodating chamber 1*a* in the connector housing 1, the projection 1*c* on the locking finger 1*d* rides on the outer face of the female terminal 2, so that the locking finger 1*d* projects outwardly from the outer face of the side wall 1*b* in the same manner as the prior art (see FIG. 17). This indicates an incomplete coupling of the female terminal 2.

In the case that the female terminal 2 is completely inserted into the terminal accommodating chamber 1*a* in the connector housing 1, the projection 1*c* engages with the aperture 2*a* in the female terminal 2 to lock the terminal 2.

Further, since the locking finger 1*d* is inwardly provided below the outer face of the side wall 1*b* of the connector housing 1 i.e., on the bottom of the recess 1*g*, the locking finger 1*d* hardly receives an external impact. Since the digits 1 to 10 indicating the pole number of the female terminal 2 are carved on the slanted portion 1*h*, the digits can be seen more easily than the case of carving the digits on the flat face, thereby making it easy to confirm the accommodating position of the female terminal 2 and to effect an accommodating work of the terminal 2.

In the case that the female terminal 2 is detached from the terminal accommodating chamber 1*a* in order to alter an accommodating position of the female terminal 2 after the female terminal 2 has been accommodated in the chamber 1*a* in the connector housing 1, a flat tool 5 is inserted at its end from the out side into a gap between the distal end of the locking finger 1*d* and the inner end 1*e* (FIG. 4).

Upon inserting the tool 5, the slanted portion 1*h* widens the gap between the distal end of the locking finger 1*d* and the inner end 1*e* and guides the tool 5, thereby making it easy to insert the tool 5 into the gap.

It will be apparent from the foregoing that in the first and second embodiments of the joint connector of the present invention since the locking finger is arranged inwardly below the outer face of the side wall and the slanted portion extends from an inward position aligned to the distal end of the locking finger to an outward position, a gap between the distal end of the locking finger and the end face of the side wall can be widened and the tool can be guided along the slanted portion to be easily inserted into the gap. Also, since the fulcrum for swinging the tool exists at an upper end of the slanted portion, a distance from the fulcrum and the acting point becomes long and excessive stress is not concentrated on the locking finger which would otherwise deform it.

In the case that the locking finger is arranged below the outer face of the side wall of the connector housing, the locking finger hardly receives an impact from the exterior. Further, if marks such as digits indicating pole numbers of female terminals which are accommodated in terminal accommodating chambers are carved on the outer face of the side wall continued to the slanted portion, it is possible to confirm a position in which a certain female terminal should be inserted and to enhance an accommodating work.

Next, third and fourth embodiments of the joint connector of the present invention will be explained below by referring to FIGS. 5A to 6B.

Figure 5A:
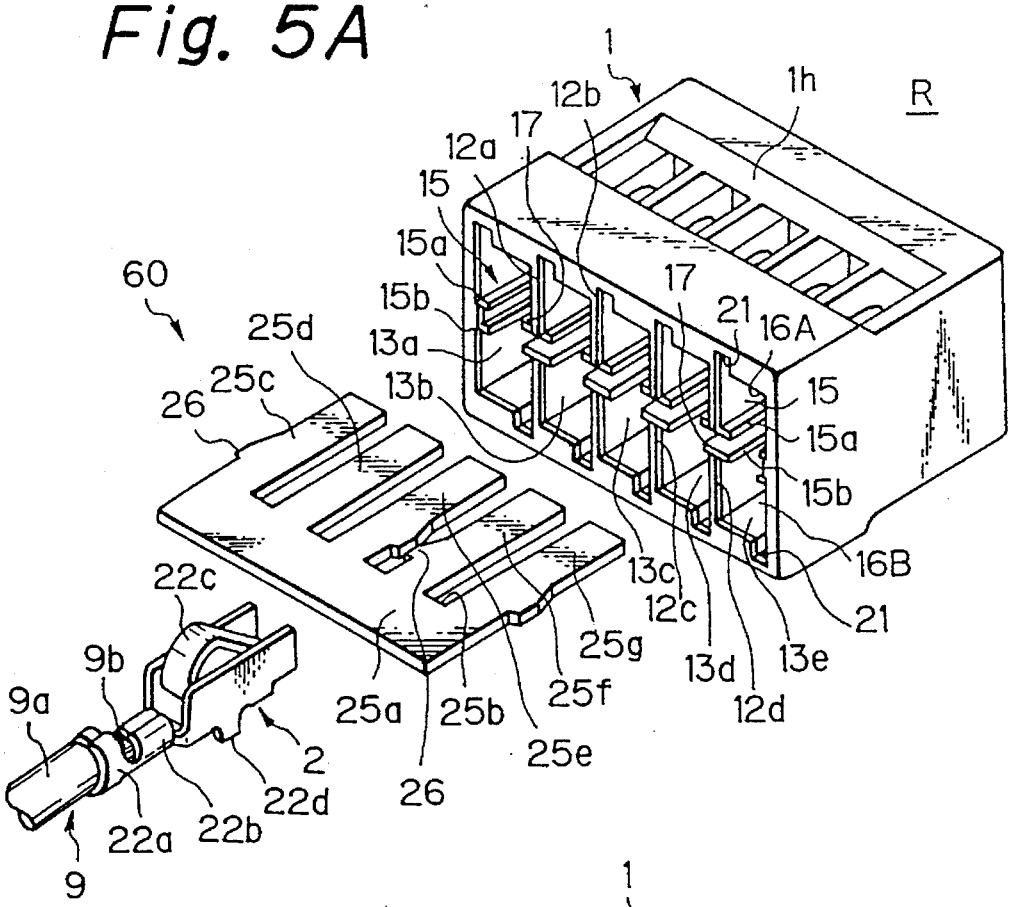
FIG. 5A is an exploded perspective view of a third embodiment of a joint connector having an all pole shorting function in accordance with the present invention.
Figure 5B:
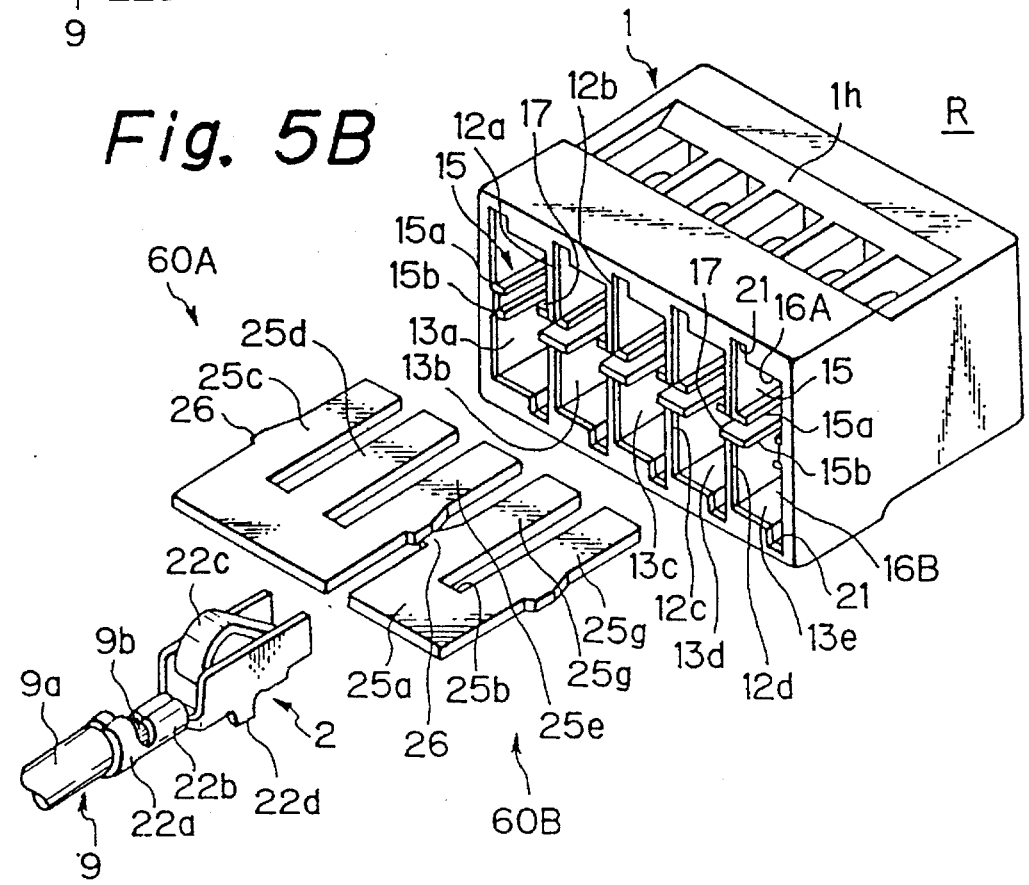
FIG. 5B is an exploded perspective view of a fourth embodiment of a joint connector having a divisional shorting function in accordance with the present invention.
Figure 6A:
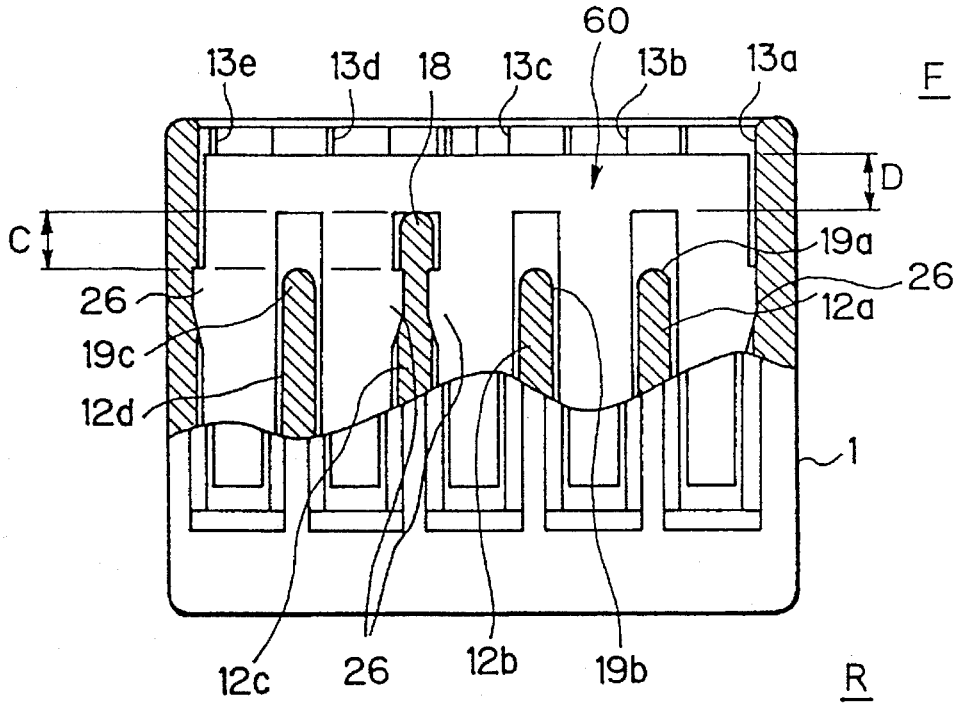
FIG. 6A is a fragmentary broken side view of the joint connector shown in FIG. 5A.
Figure 6B:
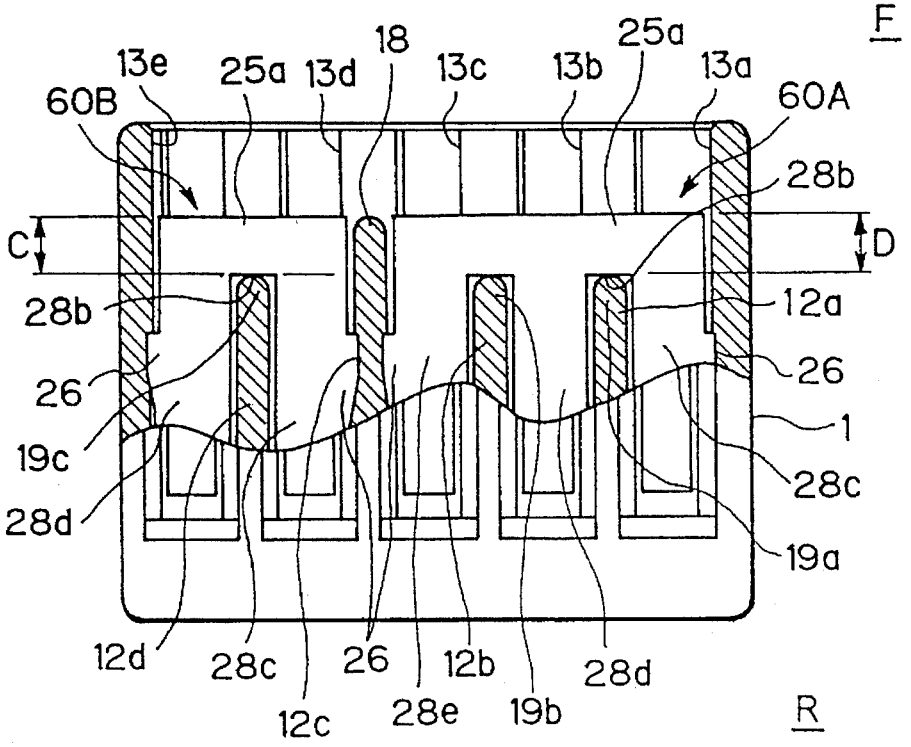
FIG. 6B is a fragmentary broken side view of the joint connector shown in FIG. 5B.

The embodiments of the joint connector have an all pole shorting function which serves to connect a plurality of female terminals 2 to a single circuit (FIGS. 5A and 6A) and a divisional shorting function which serves to connect the female terminals to two branched circuits (FIGS. 5B and 6B).

A connector housing made of a resin material is provided with terminal accommodating chambers 13*a*, 13*b*, 13*c*, 13*d*, 13*e* partitioned by side walls 12*a*, 12*b*, 12*c*, 12*d*. The terminal accommodating chambers 13*a* to 13*e* are provided with guide rail parts 15 which guide shorting plates 60, 60A and 60B described hereinafter. Each guide rail part 15 includes a pair of upper guide rails 15*a* and a pair of lower guide rails 15*b*. The terminal accommodating chambers 13*a* to 13*e* are partitioned into upper and lower divided chambers 16A and 16B by the shorting plates 60, 60A and 60B guided by the guide rail parts 15 into the chambers 13*a* to 13*e*. The female terminals 2 are received in the divided chambers 16A and 16B.

The side walls 12*a* to 12*d* are provided between the upper and lower guide rails 15*a* and 15*b* with grooves 17 which extends from the front side F to the rear side R. In these embodiments, as shown in FIGS. 6A and 6B, an end 18 of the side wall 12C on the front side projects more than ends 19*a*, 19*b*, 19*c* of the side walls on the front side. The side wall 12C serves to limit an inserting position of the shorting plate 60 in the case of the all pole shorting function of the third embodiment (FIG. 6A). A projected distance c of the projected end 18 is set to be more than a width D of the coupling portion 25*a* of the shorting plate 60.

On the other hand, the ends 19*a* to 19*c* of the side walls 12*a*, 12*b* and 12*d* except the end 18 of the side wall 12*c* extend to the same distance on the front side F. In the fourth embodiment of the divisional shorting plates as shown in FIG. 6B, the side walls 19*a*, 19*b* and 19*c* limit an inserting position of the shorting plates 60A and 60B.

The divided chambers 16A an 16B of the terminal accommodating chambers 13*a* to 13*e* are provided with guide grooves 21 for guiding the female terminals from the front side to the rear side.

The female terminal 2 is provided with a sheath clamping portion 22*a* for a sheath 9*a* of the electrical wire 9 and a conductor clamping portion 22*b* for conductors 9*b* of the electrical wire 9. The female terminal 2 is also provided with a tongue piece 22*c* made of an elastic material and adapted to contact with contacting portions 25*c*, 25*d*, 25*e*, 25*f*, 25*g* of the shorting plates 60, 60A, 60B. Further, the female terminal 2 is provided with a guide piece 22*d*, which is adapted to be inserted into the divided chambers 16A and 16B while being guided by the guide grooves 21.

The shorting plate 60 for the use of all pole shorting has the contacting portions 25*c*, 25*d*, 25*e*, 25*f*, 25*g* integrally connected to a side face 25*b* of the coupling portion 25*a*. Some of contacting portions 25*c* to 25*g* (25*c*, 25*e*, 25*f*, 25*g* in the third embodiment) are provided with pawls 26 adapted to be pushed into the side walls 12.

The shorting plate 60 for the use of all pole shorting is inserted into the groove 17 by the guide rail parts 15 to be pushed into the connector housing 1. The contacting portions 25*c* to 25*g* are received in the terminal accommodating chambers 13*a* to 13*e*. Then, the shorting plate 60 is inserted into the connector housing 1 until the side face 25*b* of the coupling portion 25*a* abuts on the projected end 18. The projected end 18 limits the inserting position of the shorting plate 60.

After inserting the shorting plate 60 into the connector housing 1, the female terminals 2 are inserted into the divided chambers 16A and 16B, so that the tongue pieces 22*c* of the female terminals 2 contact with the contacting portions 25*c* to 25*g* of the shorting plate 60 to form a branched circuit.

The shorting plates 60A and 60B for the use of divisional shorting shown in FIGS. 5B and 6B have contacting portions 28*c*, 28*d*, 28*e* integrally connected to a side face 28*b* of the coupling portions 25*a* in the same manner of the shorting plate 60 for the use of all pole shorting.

The shorting plates 60*a* and 60B for the use of divisional shorting are inserted into the connector housing 1 so that the contacting portions 28*c* to 28*e* are received in the terminal accommodating chambers 13*a* to 13*e*, in the same manner as the case of all pole shorting. Then, since the side wall 12*c* having the projected end 18 is disposed between the shorting plates 60A and 60B, the side faces 28*b* of the coupling portions 28*a* of the shorting plates 60A and 60B abut on the ends 19*a*, 19*b*, 19*c* of the side 12*a*, 12*b*, 12*d*, to limit the inserting position of the plates. Then, the female terminals 2 are inserted into the divided chambers 16A and 16B to form two branched circuits associated with the shorting plates 60A and 60B.

As shown in FIG. 6B, since the end 18 is projected from the other ends by a distance C more than a width D of the coupling portion 25*a*, the projected end 18 is disposed between the coupling portions 25*a* of the shorting plates 60A and 60B. Even if potentials between the branched circuits formed by the shorting plates 60A and 60B are different, no leak occurs on account of interposition of an insulation material and a short-circuit between the branched circuits can be prevented.

The present invention should not be limited to the above embodiments and may include various alternations.

For example, although the side wall 12*c* having the end 18 and two shorting plates 60A and 60B form two branched circuits in the third and fourth embodiments, more than three branched circuits may be formed by increasing the shorting plates and projected ends.

It will be apparent from the foregoing that in the third and fourth embodiments of the joint connector of the present invention the connector housing can be used in all pole shorting and divisional shorting since the connector housing includes first side walls the distal ends of which abut on the coupling portions of the shorting plates for the divisional shorting use and a second side wall the distal end of which abuts on the coupling portion of the shorting plate for the all pole shorting use. Also, the connector housing can be used in both all pole shorting function and divisional shorting function. Since the side wall is disposed between the divisional shorting plates, insulation between the shorting plates is improved, so that leak is prevented.

In the case that the distal end of the second wall for positioning the shorting plate for the all pole shorting use extends by more than a width of the coupling portion of said shorting plate above the distal ends of the side walls for positioning the shorting plates for the divisional shorting use, it is possible to further enhance insulation between the shorting plates, thereby positively preventing leakage.

According to the joint connector of the present invention, since insulation is enhanced and leaking is prevented, it is possible to make the side wall of the connector housing thin, to make a pitch between the female terminals short and to make the connector housing compact and light.

Next, a fifth embodiment of the joint connector of the present invention will be described below by referring to FIGS. 7 to 9.

Figure 7:
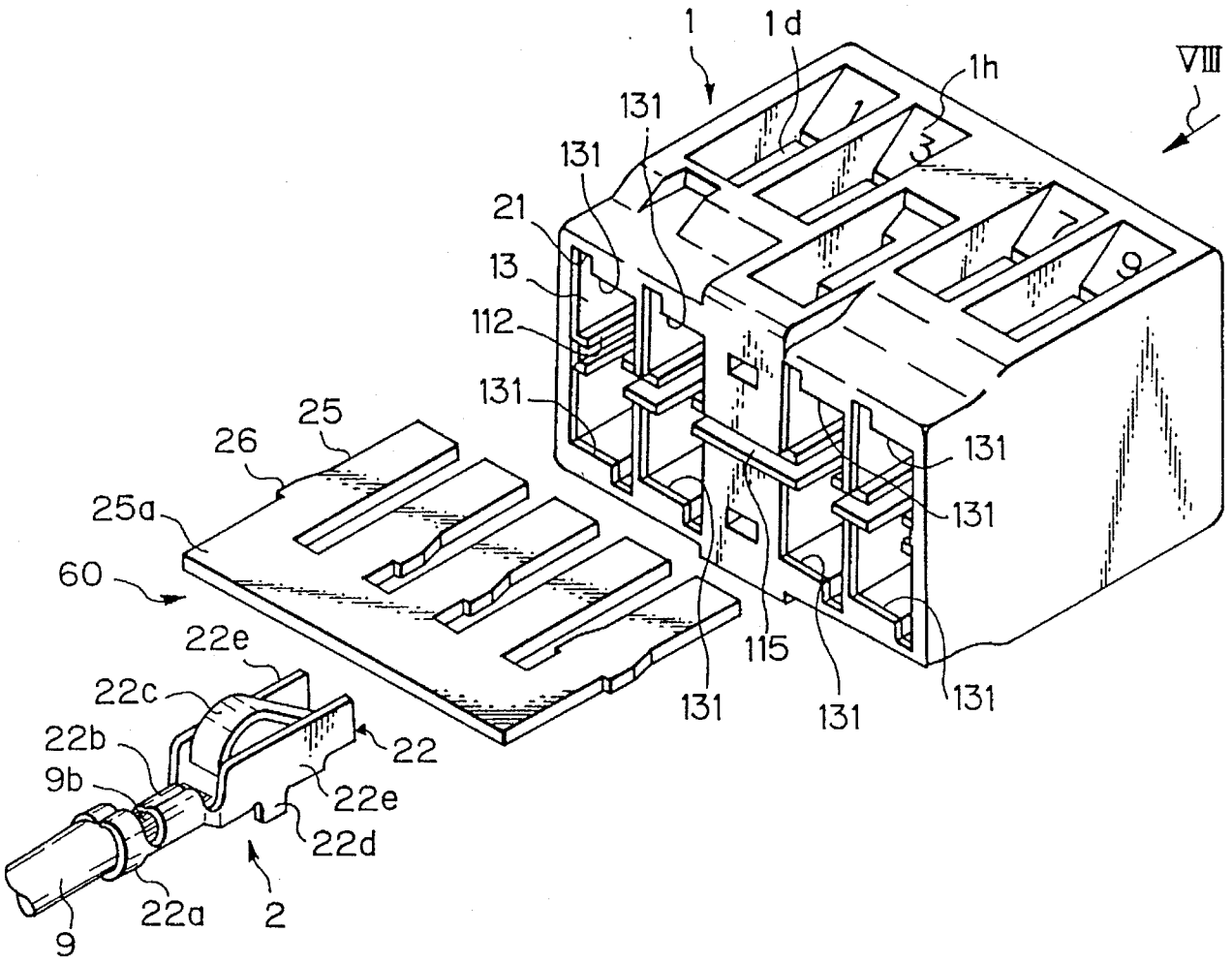
FIG. 7 is an exploded perspective view of a fifth embodiment of a joint connector of the present invention.
Figure 8:
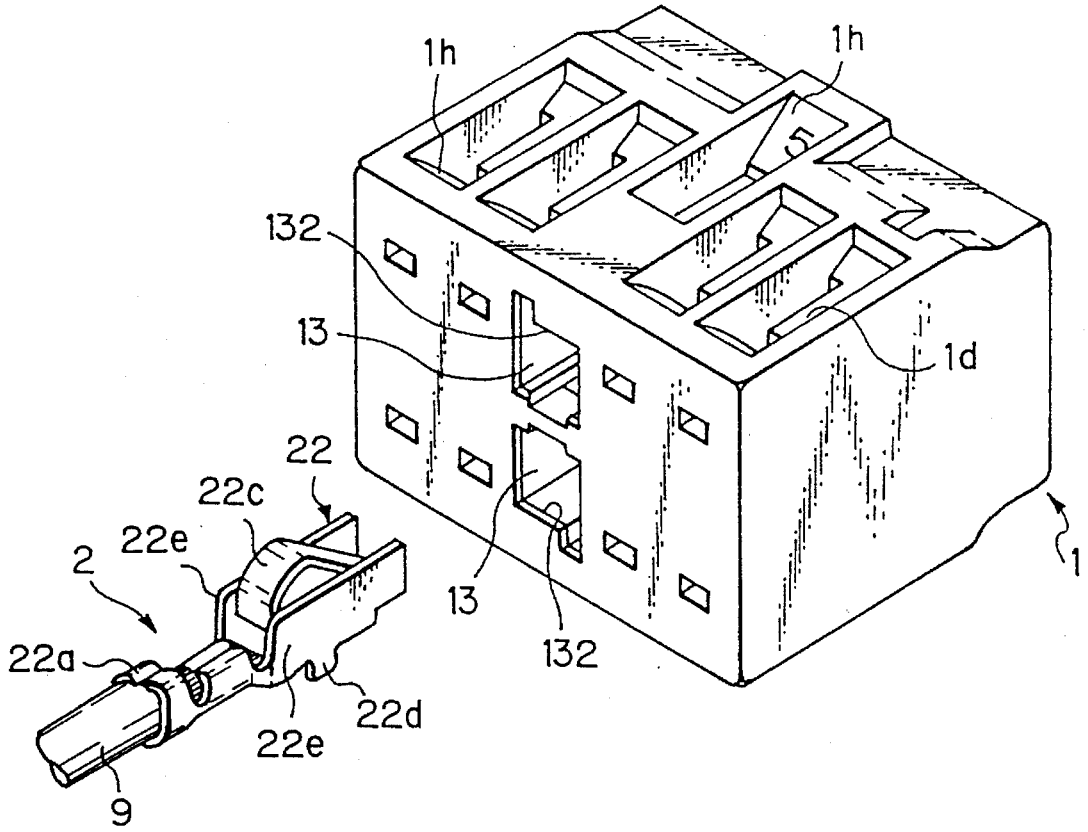
FIG. 8 is an exploded perspective view of the joint connector taken from an arrow VIII in FIG. 7.

FIG. 7 is an exploded perspective view of a fifth embodiment of a joint connector of the present invention. FIG. 8 is an exploded perspective view of the joint connector taken from an arrow VIII in FIG. 7.

Figure 9:
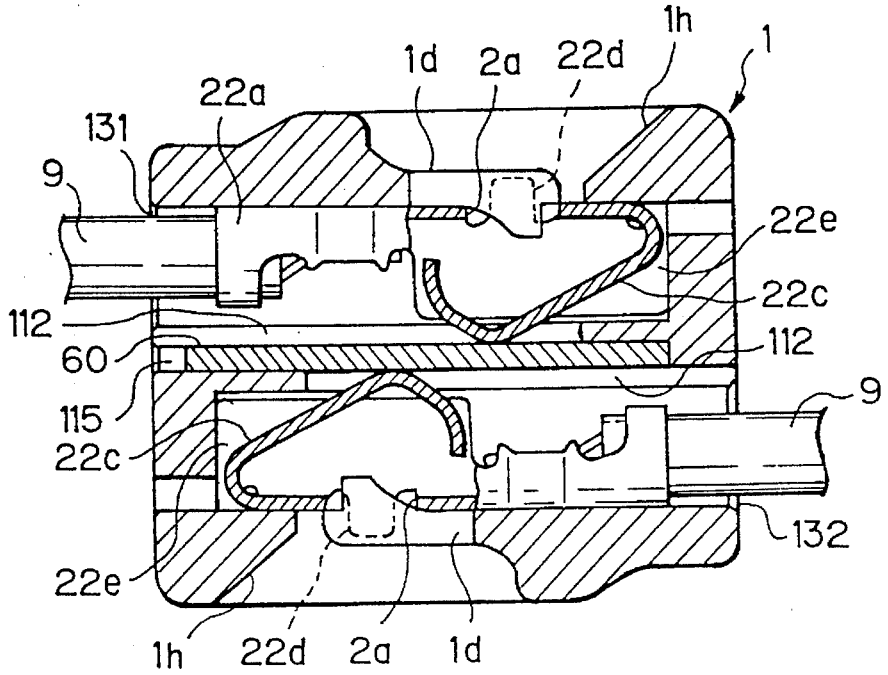
FIG. 9 is a longitudinal sectional view of the joint connector FIG. 7.

FIG. 9 is a longitudinal sectional view of the joint connector FIG. 7.

In the drawings, a connector housing 1 is provided on upper and lower stages with five terminal accommodating chambers 13. Although the terminal accommodating chambers 13 are arranged in parallel with each other, the center chambers 13 are directed in opposite directions from the other chambers. On opening 131 of the chamber 13 is used as an inserting port. Accordingly, there are eight openings 131 on a front side (FIG. 7) and two openings 132 on a rear side (FIG. 8).

A joint chamber 115 adapted to receive the shorting plate 60 is provided between the upper and lower terminal accommodating chambers 13. Upper and lower walls of the joint chamber 115 are provided with apertures 112 which are communicated with the joint chamber 115. Upper and lower walls of the upper and lower terminal accommodating chambers 13 are provided with guide grooves 21 which receive guide projection 22*d* of the female terminal 2.

The shorting plate 60 is inserted into the joint chamber 115 formed between the upper and lower terminal accommodating chambers 13. The shorting plate 60 has a plurality of tab like contacting portions 25 adapted to be inserted into the apertures 112 and a coupling portion 25*a* which connects proximal ends of the contacting portions 25 together at a certain spaced pitch. Some contacting portions 25 are provided with pawls 26 for preventing of falling off. The joint chamber 115 is provided with jointing walls in connection with the spaced pitch of the contacting portions 25. When the shorting plate 60 is inserted into the connector housing 1, the contacting portions 25 advance in the chamber 13 while contacting the pawl 26 with the jointing walls. When the shorting plate 60 reaches a limit position, the pawls 26 serve to constrain the plate 60 from falling off.

The female terminal 2 is provided at a front side with a contacting portion 22 which contacts with the contacting portion 25 of the shorting plate 60 and at a rear side with a barrel portion 22*a* which holds the electrical wire 9. The contacting portion 22 is provided on opposite sides with standing side walls 22*e*, 22*e* and at an end with a resilient tongue piece 22*c* which is formed by folding a center plate toward a space between the standing side walls 22*e*, 22*e*. One of the walls 22*e* is provided at its bottom with a projection 22*d* extending downwardly. The contacting portion 22 is provided at rear side, namely at an opposite side of the tongue piece 22*c* with a lock aperture 2*a*.

An inner part of the terminal accommodating chamber 13 is formed to receive the contacting portion 25. The connector housing 1 is provided on an outer wall of the chamber 13 with a resilient locking finger 1*d* having a projection 1*c* which is adapted to be engaged with the aperture 2*a* of the female terminal 2.

Next, an operation of the embodiment constructed above will be explained below.

First, when the shorting plate 60 is inserted into the connector housing 1, the contacting portions 25 of the plate 60 are confronted to the apertures 112 in the chambers 13. In this embodiment, the contacting portions 25 of the shorting plate 60 are confronted to all apertures 112.

Now, eight electrical wires 9 and two electrical wires 9 are introduced from opposite directions and they are interconnected through the joint connector at their intermediate positions. The distal ends of the respective electrical wires 9, 9 are connected to the barrel portions 22*a* of the female terminals 2.

The eight electrical wires 9 are inserted into the eight openings 131 of the terminal accommodating chambers 13 on one side until the projections 1*c* of the locking fingers 1*d* engage with the apertures 2*a*. The two electrical wires 9 are inserted into the two openings 131 of the chambers 13 on the other side until the projections 1*c* of the locking finger 1*d* engage with the apertures 2*a*.

As shown in FIG. 9, when the contacting portions 25 are inserted into the inner parts of the terminal accommodating chamber 13, the projections 1*c* of the locking fingers 1*d* engage with the lock aperture 2*a* of the female terminals 2 to hold them in the chambers 13. Accordingly, the eight electrical wires 9 are inserted and held in the chambers 13 directed to one side and the two electrical wires 9 are inserted and held in the chambers directed to the other side opposite to the one side. The electrical wires 9 are arranged in a straight line with respect to the connector housing 1.

On the other hand, since the tongue piece 22*c* of the contacting portion 25 passes through and projects from the aperture 112, the tongue piece 22c contacts with the contacting portion 25 of the shorting plate 60 which are confronted to the aperture 112.

As described above, since the contacting portions 25 of the shorting plate 60 are inserted into the connector housing 1 so that the portions 25 are confronted to all apertures 112, the contacting portions 22 of the female terminals 2 accommodated in the terminal accommodating chambers 13 are electrically interconnected through the contacting portions 25 and coupling portion 25a of the shorting plate 60.

Although the two center terminal accommodating chambers 13 are opened in the direction opposite to the other chambers 13 in the fifth embodiment, another arrangement may be carried out.

Although it is not shown in the drawings, the terminal accommodating chambers 13 may be reversed in the upper and lower stages.

In such an arrangement, two sets of five electrical wires 9 extending in the opposite directions can be inserted into the respective openings.

As the joint chamber 115 is disposed between the upper and lower terminal accommodating chambers 13 and each chamber 13 is communicated with the joint chamber 115 through the aperture 112, the female terminals 2 accommodated in the chambers 13 are contacted through the aperture 112 with the shorting plate 60 to be electrically connected to each other.

Although a single shorting plate 60 interconnects the female terminals 2 accommodated in the chamber 13 in the fifth embodiment, a plurality of shorting plates separated at the coupling portion 25a described above may be used to define a plurality of groups of the electrical wires to be interconnected.

In the fifth embodiment of the joint connector of the present invention, the openings of the terminal accommodating chambers are formed in accordance with the directions of the electrical wires to be connected. Consequently, the wires can be arranged in a straight line and the connector housing does not interfere with laying of the electrical wires.

Next, a sixth embodiment of the joint connector of the present invention will be explained below by referring to FIGS. 10 to 14.

Figure 10:
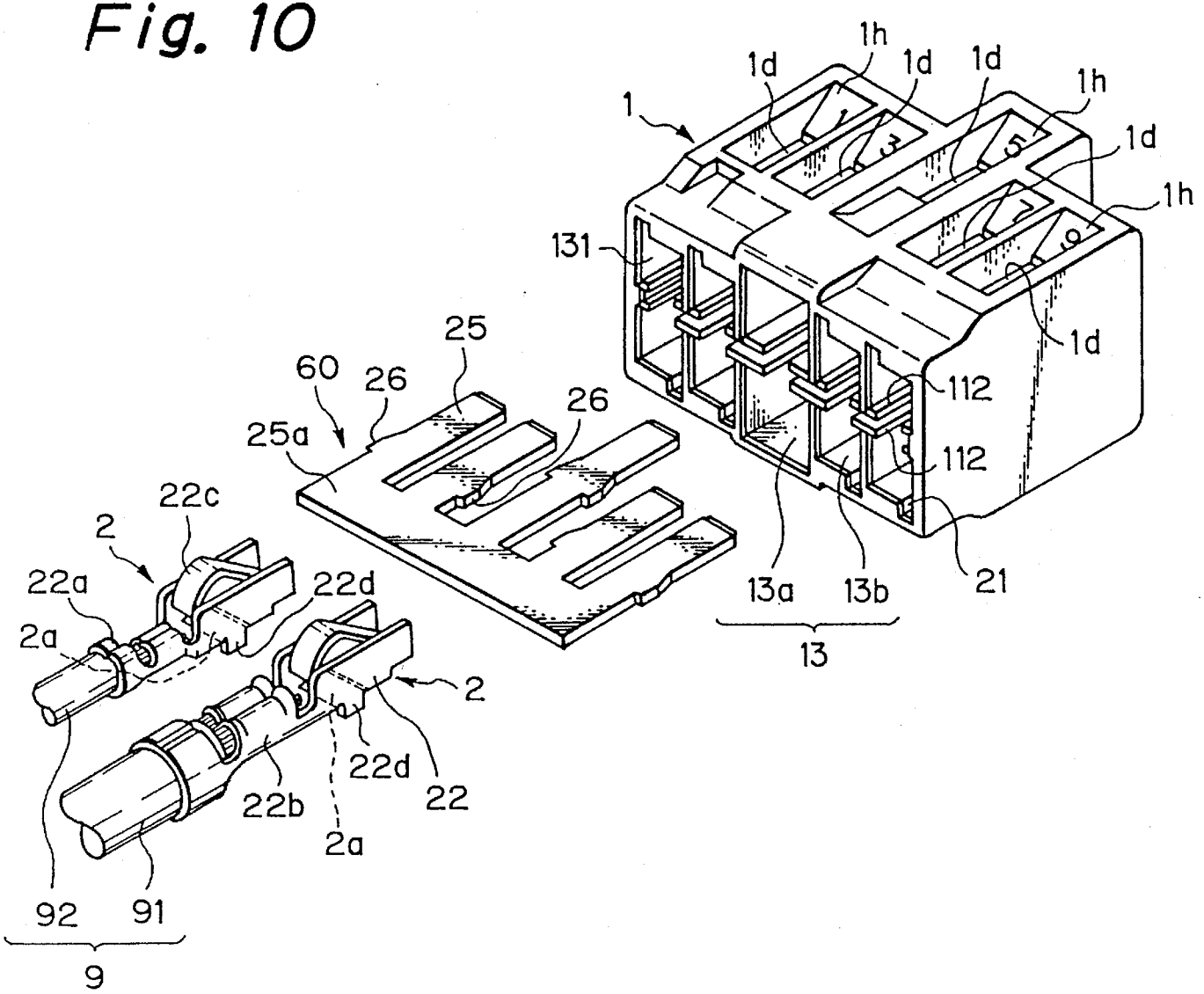
FIG. 10 is an exploded perspective view of a sixth embodiment of a joint connector of the present invention.

FIG. 10 is an exploded perspective view of a sixth embodiment of a joint connector of the present invention.

In FIG. 10, a connector housing 1 is formed into a box like body having an opening 131 at one side. Partitions extending from the opening to an inner part define ten terminal accommodating chambers 13 with five chamber 13 being arranged in upper and lower stages. Two center upper and lower chambers 13a have larger openings 131 and a greater depth than those of the other chambers 13b.

A space adapted to receiver the shorting plate 60 is provided between the upper and lower terminal accommodating chambers 13. Upper and lower walls of the space are provided with apertures 112 which are communicated with the joint chamber 115. Upper and lower walls of the upper and lower terminal accommodating chambers 13 are provided with guide grooves 21 which receive guide projection 22d of the female terminal 2.

The shorting plate 60 is inserted into the space formed between the upper and lower terminal accommodating chambers 13. The shorting plate 60 has a plurality of tab like contacting portions 25 adapted to be inserted into the apertures 112 and a coupling portion 25a which connects proximal ends of the contacting portions 25 together at a certain spaced pitch. Some contacting portions 25 are provided with pawls 26 to prevent displacement. The space is provided with jointing walls in connection with the spaced pitch of the contacting portions 25. When the shorting plate 60 is inserted into the connector housing 1, the contacting portions 25 advance in the chamber 13 which contacting the pawl 26 with the jointing walls. When the shorting plate 60 reaches a limit position, the pawls 26 serve to prevent the plate 60 from falling off.

Figure 11:
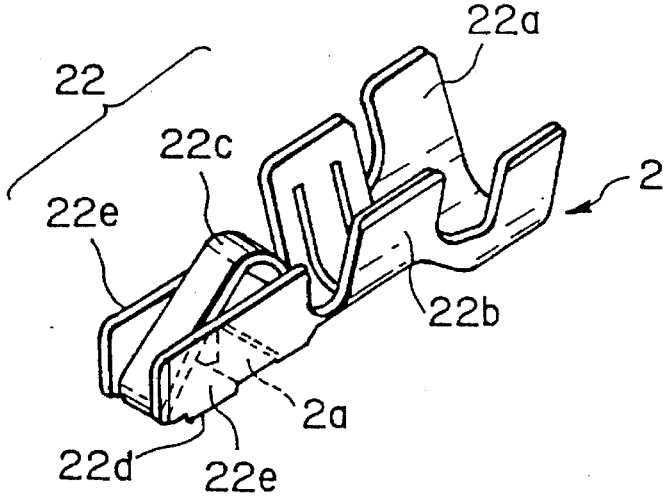
FIG. 11 is a perspective view of a female terminal for use with an electrical wire with a large diameter.
Figure 12:
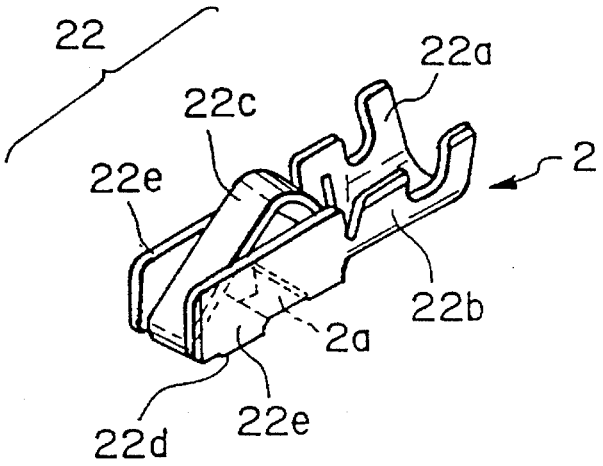
FIG. 12 is a perspective view of a female terminal for use with an electrical wire with a small diameter.

The female terminal 2 is provided at a front side with a contacting portion 22 which contacts with the contacting portion 25 of the shorting plate 60 and at a rear side with a barrel portion 22a which holds the electrical wire 9. A female terminal 2 shown in FIG. 11 is used for an electrical wire 91 having a larger diameter while a female terminal 2 shown in FIG. 12 is used for an electrical wire 92 having a smaller diameter. Both female terminals 2 have the same size and shape with respect to the contacting portions 22 but have different sizes of barrel portions 22a to correspond with the electrical wires having different diameters.

The contacting portion 22 is provided on opposite sides with standing side walls 22e, 22e and at an end with a resilient tongue piece 22c which is formed by folding a center plate toward a space between the standing side walls 22e, 22e. One of the walls 22e is provided at a bottom with a projection 22d extending downwardly. The contacting portion 22 is provided at a rear side, namely at an opposite side of the tongue piece 22c with a lock aperture 2a.

Figure 13:
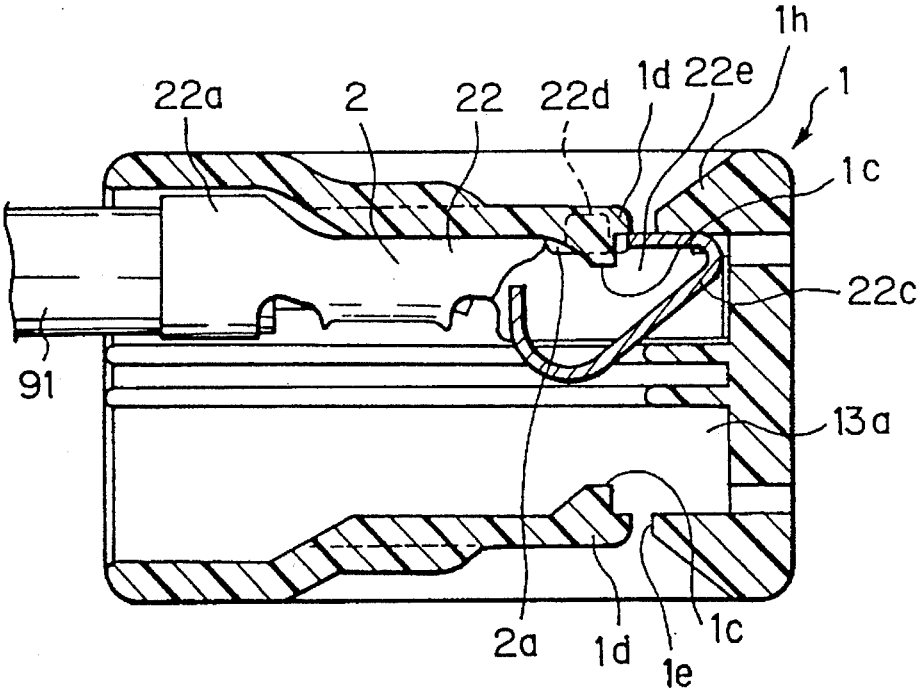
FIG. 13 is a longitudinal sectional view of a joint connector of the present invention, illustrating a large terminal accommodating chamber which receives the electrical wire with a large diameter.
Figure 14:
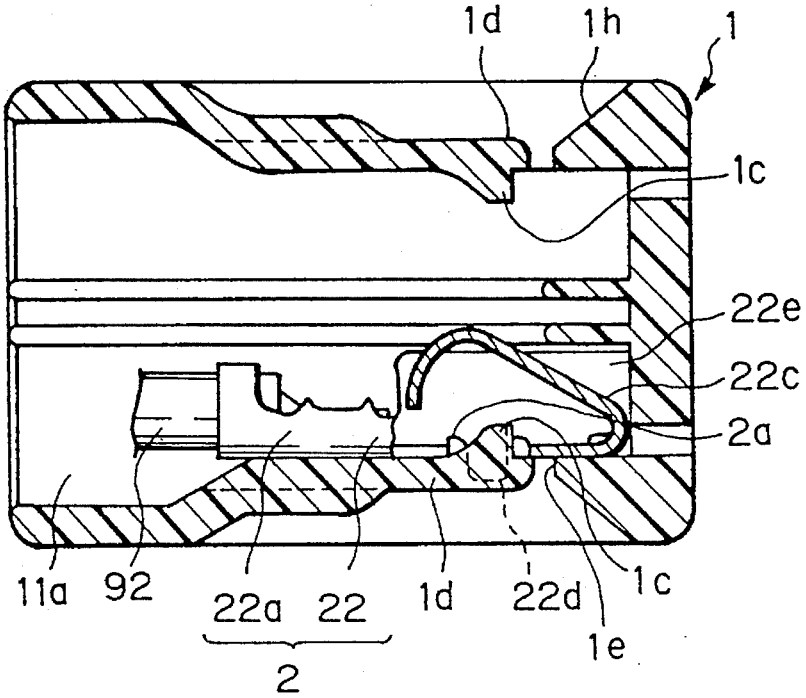
FIG. 14 is a longitudinal sectional view of a joint connector of the present invention, illustrating a large terminal accommodating chamber which receives the electrical wire with a small diameter.
Figure 15:
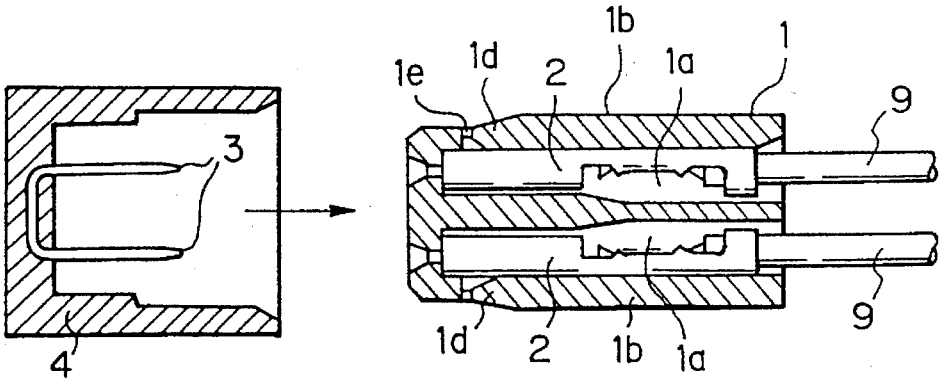
Fig. 15 PRIOR ART
FIG. 15 is an exploded longitudinal sectional view of a prior joint connector before having a cover mounted thereon.
Figure 16:
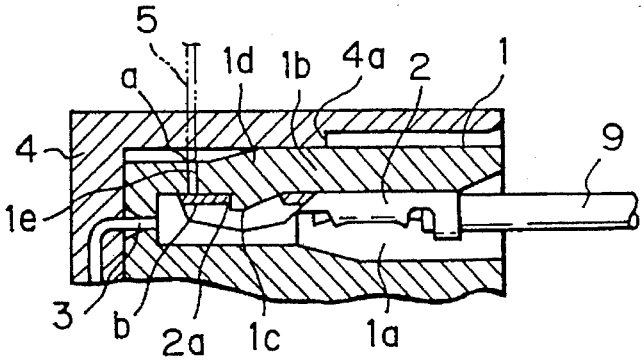
Fig. 16 PRIOR ART
FIG. 16 is a longitudinal sectional view of a part of the joint connector shown in FIG. 15, illustrating the connector on which the cover is mounted.

An inner part of the terminal accommodating chamber 13 is formed to receive the contacting portion 25. The connector housing 1 is provided on an outer wall of the chamber 13 with a resilient locking finger 1d having a projection 1c which is adapted to be engaged with the aperture 2a of the female terminal 2 (FIG. 13).

The barrel portion includes an insulation barrel 22a for clamping a sheath of the electrical wire 9 and a conductor barrel 22b for clamping conductors of the electrical wire 9. The barrels 22a and 22b have different sizes in accordance with the larger and smaller diameter wires 91 and 92.

Next, an operation of the embodiment constructed above will be explained below.

First, when the shorting plate 60 is inserted into the connector housing 1, the contacting portions 25 of the plate 60 confront the apertures 112 in the chambers 13. In this embodiment, the contacting portions 25 of the shorting plate 60 confront all apertures 112.

On the other hand, an end of the electrical wire 91 is connected to a primary side while the other end of the wire 91 is clamped by the barrel 22a of the female terminal 2 for the larger diameter wire 91. An end of the electrical wire 92 is connected to a secondary side of an electrical device while the other end of the wire 92 is clamped by the barrel 22a of the female terminal for the smaller diameter wire 92.

The female terminal 2 connected to the electrical wire 91 is inserted into the terminal accommodating chamber 13a until the projection 1c of the locking finger 1d engages with the lock aperture 2a. A plurality of female terminals 2 connected to a plurality of electrical wires 92 are inserted into the terminal accommodating chambers 13b until the projections 1c of the locking fingers 1d engage with the lock apertures 2a. When the contacting portion 22 is inserted into the inner parts of the terminal accommodating chamber 13, as shown in FIG. 13, the projection 1c of the locking finger 1d of the connector housing 1 engages with the lock aperture 2a of the female terminal 2 to hold the terminal 2 in the chamber 13. Then, the tongue piece 22c of the contacting portion 22 projects through the aperture 112, so that the tongue piece 22*c* contacts with the contacting portion 25 of the shorting plate 60 to thereby confront the aperture 112.

As described above, as the contacting portions 25 of the shorting plate 60 are inserted into the connector housing 1 so that the portions 25 confront all apertures 112, the contacting portions 22 of the female terminals 2 accommodated in the terminal accommodating chambers 13 are electrically interconnected through the contacting portions 25 and coupling portion 25*a* of the shorting plate 60.

That is, the larger diameter wire 91 is branched and connected through the shorting plate 60 to the smaller diameter wires 92 on the secondary side.

In the above embodiment, the female terminal 2 connected to the larger diameter wire 91 is inserted into the larger chamber 13*a* while the female terminal 2 connected to the smaller diameter wire 92 is inserted into the smaller chamber 13*b*. However, even if the latter is inserted into the larger chamber 13*a*, it can be held in the chamber 13*a* since the size and shape of the inner parts in both chambers 13*a* and 13*b* are the same.

In other words, the larger terminal accommodating chamber 13*a* in the connector housing 1 can be utilized for the smaller diameter wire 92 as well as the larger diameter wire 91.

Although a single shorting plate 60 interconnects the female terminals 2 accommodated in the chamber 13 in the sixth embodiment, a plurality of shorting plates separated at the coupling portion 25*a* described above may be used to define a plurality of groups of the electrical wires to be interconnected.

Thus, there are a plurality of terminal accommodating chambers 13 in the connector housing 1 and they can accommodate and interconnect the larger and smaller diameter wires 91 and 92 at the same time. Also, since the respective female terminals 2 have common contacting portions 22, even smaller diameter wire can be held in the larger chamber 13*a* and thus the chamber 13*a* is not limited to the use of a larger diameter wire.

It will be apparent from the foregoing that the sixth embodiment of the joint connector can accommodate different diameter wires and can utilize any electrical wires suitable for a desired electrical capacity.

Further, since the smaller diameter wire can be inserted to the larger terminal accommodating chamber, the same diameter wires can be inserted into the chamber.

What is claimed is:

1. A joint connector comprising a connector housing having a front and a back and containing electrical wires having terminals on their distal ends, certain said terminals being electrically coupled to each other through a shorting plate, a first group of terminal accommodating chambers and a second group of terminal accommodating chambers in said connector housing, said first group superposed on said second group and spaced apart therefrom, a joint chamber between said first group and second group, apertures in at least some of said first chambers and said second chambers communicating with said joint chamber, said shorting plate in said joint chamber facing said apertures, said first chambers and said second chambers each having an open end, adapted for introduction of one of said terminals, and a closed end remote therefrom, at least one of said first chambers and said second chambers having its open end facing said front and at least one of said first chambers and said second chambers having its open end facing said back, said certain terminals having a tongue piece which projects through said apertures into said joint chamber when said certain terminals are in said chambers.

2. The connector of claim 1 wherein at least one of said first chambers and at least one of said second chambers faces said back, the remaining said first chambers and said second chambers facing said front.

3. The connector of claim 1 wherein said first chambers are parallel to each other and in side-by-side relationship, and said second chambers are parallel to each other and in side-by-side relationship, wherein one of said first chambers and one of said second chambers faces said back, the remaining said first chambers and said second chambers facing said front.

4. The connector of claim 1 wherein either said first group or said second group faces said back and another of said first group and said second group faces said front.

5. The connector of claim 1 wherein a wall of at least one of said chambers is provided with a resilient locking finger having a lock projection thereon, said lock projection projecting into a lock receptacle on said terminal in said one of said chambers.

* * * * *